US009284714B2

(12) United States Patent
Takaura

(10) Patent No.: US 9,284,714 B2
(45) Date of Patent: Mar. 15, 2016

(54) HYDRAULIC EXCAVATOR

(71) Applicant: KOMATSU LTD., Tokyo (JP)

(72) Inventor: Takeshi Takaura, Minoh (JP)

(73) Assignee: KOMATSU LTD., Tokyo (JP)

( * ) Notice: Subject to any disclaimer, the term of this patent is extended or adjusted under 35 U.S.C. 154(b) by 72 days.

(21) Appl. No.: 14/370,069

(22) PCT Filed: Apr. 24, 2014

(86) PCT No.: PCT/JP2014/061537
§ 371 (c)(1),
(2) Date: Jul. 1, 2014

(87) PCT Pub. No.: WO2014/192473
PCT Pub. Date: Dec. 4, 2014

(65) Prior Publication Data

US 2015/0240446 A1 Aug. 27, 2015

(30) Foreign Application Priority Data

Dec. 6, 2013 (WO) ..... PCT/JP2013/082825

(51) Int. Cl.

| | |
|---|---|
| ***E02F 9/22*** | (2006.01) |
| ***E02F 3/43*** | (2006.01) |
| ***E02F 3/32*** | (2006.01) |
| ***E02F 3/42*** | (2006.01) |

(52) U.S. Cl.
CPC . *E02F 3/435* (2013.01); *E02F 3/32* (2013.01); *E02F 3/425* (2013.01); *E02F 9/22* (2013.01); *E02F 9/2228* (2013.01); *E02F 9/2285* (2013.01); *E02F 9/2292* (2013.01); *F15B 2211/329* (2013.01); *F15B 2211/355* (2013.01); *F15B 2211/36* (2013.01); *F15B 2211/6316* (2013.01); *F15B 2211/6346* (2013.01); *F15B 2211/6355* (2013.01); *F15B 2211/665* (2013.01); *F15B 2211/67* (2013.01); *F15B 2211/8613* (2013.01); *Y10T 137/87064* (2015.04)

(58) Field of Classification Search
None
See application file for complete search history.

(56) References Cited

U.S. PATENT DOCUMENTS

| | | | | | |
|---|---|---|---|---|---|
| 5,598,648 | A * | 2/1997 | Moriya | E02F 3/437 | 37/348 |
| 5,957,989 | A * | 9/1999 | Egawa | E02F 9/2033 | 37/348 |
| 6,006,521 | A * | 12/1999 | Fuchita | E02F 9/2228 | 60/422 |
| 6,098,322 | A * | 8/2000 | Tozawa | E02F 3/437 | 37/414 |

(Continued)

FOREIGN PATENT DOCUMENTS

| | | |
|---|---|---|
| CN | 201538977 U | 8/2010 |
| CN | 102071717 A | 5/2011 |

(Continued)

*Primary Examiner* — Jonathan M Dager
(74) *Attorney, Agent, or Firm* — Drinker Biddle & Reath LLP

(57) ABSTRACT

There is provided a hydraulic excavator in which invasion of a design surface by a work implement can be suppressed. A boom-lowering proportional solenoid valve is provided in a boom-lowering pilot conduit connected to a boom-lowering pilot port. A first pressure sensor detects a pressure generated in the boom-lowering pilot conduit between a control lever and the boom-lowering proportional solenoid valve. A controller controls an opening degree of the boom-lowering proportional solenoid valve based on the pressure detected by the first pressure sensor. The controller gently increases, from zero, a current value outputted to the boom-lowering proportional solenoid valve.

8 Claims, 9 Drawing Sheets

(56) References Cited

U.S. PATENT DOCUMENTS

| | | | | |
|---|---|---|---|---|
| 6,655,465 | B2 * | 12/2003 | Carlson | E02F 3/847 172/4.5 |
| 7,752,778 | B2 * | 7/2010 | Schoenmaker | E02F 9/264 37/348 |
| 7,949,449 | B2 * | 5/2011 | Koch | E02F 9/265 37/414 |
| 8,200,398 | B2 * | 6/2012 | Sahlin | E02F 3/847 37/416 |
| 8,463,508 | B2 * | 6/2013 | Nicholson | E02F 3/432 172/3 |
| 9,022,749 | B2 * | 5/2015 | Akiyama | E02F 9/123 417/212 |
| 2002/0073699 | A1 * | 6/2002 | Nishimura | B66C 13/18 60/325 |
| 2003/0019132 | A1 * | 1/2003 | Kurenuma | E02F 3/437 37/348 |
| 2009/0057040 | A1 * | 3/2009 | Yamada | B62D 11/001 180/6.48 |
| 2009/0057049 | A1 * | 3/2009 | Yamada | B62D 11/005 180/307 |
| 2012/0130599 | A1 * | 5/2012 | Faivre | E02F 9/265 701/50 |
| 2012/0232756 | A1 * | 9/2012 | Yuan | E02F 9/226 701/41 |
| 2012/0330515 | A1 * | 12/2012 | Numazaki | E02F 3/431 701/50 |
| 2014/0169923 | A1 * | 6/2014 | Shirao | B60W 10/30 414/685 |
| 2015/0107234 | A1 * | 4/2015 | Ueda | E02F 3/435 60/329 |

FOREIGN PATENT DOCUMENTS

| | | | |
|---|---|---|---|
| CN | 102071717 | | 7/2012 |
| JP | 05-272154 | A | 10/1993 |
| JP | 05-272155 | A | 10/1993 |
| JP | H07-207697 | A | 8/1995 |
| JP | 09-151487 | A | 6/1997 |
| JP | 11-350537 | A | 12/1999 |
| JP | 2001-032331 | A | 2/2001 |

* cited by examiner

HYDRAULIC EXCAVATOR

TECHNICAL FIELD

The present invention relates to a hydraulic excavator.

BACKGROUND ART

As to conventional hydraulic excavators, Japanese Patent Laying-Open No. 7-207697 (PTD 1) discloses such a configuration that an electromagnetic switching valve including an oil passage position with a throttle is provided in a conduit connected to a boom-lowering pilot port of a pilot switching valve for a boom. PTD 1 also discloses such a configuration that a pressure sensor is provided on the boom-lowering pilot port side, and a pressure signal detected by the pressure sensor is inputted to a controller.

CITATION LIST

Patent Document

PTD 1: Japanese Patent Laying-Open No. 7-207697

SUMMARY OF INVENTION

Technical Problem

In recent years, in work vehicles, there has been known a construction technique of obtaining design surface information from the outside, detecting a position of a work implement and automatically controlling the work implement based on the detected position of the work implement.

In the case of aligning a cutting edge of a bucket with a design surface in a land leveling work with a hydraulic excavator, control for automatically stopping the operation of the work implement at a position where the cutting edge comes into contact with the design surface is executed in order to avoid the cutting edge of the bucket from cutting into the design surface. For precise alignment of the cutting edge of the bucket, it is preferable that an operator operating the hydraulic excavator continues to operate a control lever toward the boom-lowering side until the work implement stops automatically.

When the operator continues to operate the control lever toward the boom-lowering side as described above, a vehicle body shakes after the work implement stops automatically, and at the moment when the cutting edge moves upwardly away from the design surface, boom-lowering is executed. As a result, the cutting edge may invade the design surface.

The present invention has been made in view of the aforementioned problem and an object thereof is to provide a technique that can suppress invasion of the design surface by the work implement.

Solution to Problem

A hydraulic excavator according to the present invention includes: a boom; a pilot switching valve for the boom; a boom-lowering pilot conduit; a boom-lowering proportional solenoid valve; a control lever; a first pressure sensor; and a controller. The pilot switching valve for the boom has a boom-lowering pilot port and controls operation of the boom. The boom-lowering pilot conduit is connected to the boom-lowering pilot port. The boom-lowering proportional solenoid valve is provided in the boom-lowering pilot conduit. The control lever is operated by an operator. The first pressure sensor detects a pressure generated in the boom-lowering pilot conduit between the control lever and the boom-lowering proportional solenoid valve. The controller controls an opening degree of the boom-lowering proportional solenoid valve based on the pressure detected by the first pressure sensor. The controller gently increases, from zero, a current value outputted to the boom-lowering proportional solenoid valve.

According to the hydraulic excavator of the present invention, by decreasing the response speed of the boom-lowering operation to the operator's operation, it is possible to suppress execution of boom-lowering again when the cutting edge temporarily moves upwardly away from the design surface due to shake of the vehicle body. Therefore, it is possible to prevent a problem that the cutting edge is located lower than the design surface and the design surface is invaded after the shake of the vehicle body stops.

In the hydraulic excavator, an amount of increase in current per unit time when the controller outputs, to the boom-lowering proportional solenoid valve, an instruction signal for instructing an increase in opening degree is smaller than an amount of decrease in current per unit time when the controller outputs, to the boom-lowering proportional solenoid valve, an instruction signal for instructing a decrease in opening degree. Thus, the boom-lowering operation can be immediately stopped when the boom-lowering operation becomes unnecessary.

In the hydraulic excavator, the pilot switching valve for the boom further has a boom-raising pilot port. The hydraulic excavator further includes: a boom-raising pilot conduit; a boom-raising proportional solenoid valve; and a second pressure sensor. The boom-raising pilot conduit is connected to the boom-raising pilot port. The boom-raising proportional solenoid valve is provided in the boom-raising pilot conduit. The second pressure sensor detects a pressure generated in the boom-raising pilot conduit between the control lever and the boom-raising proportional solenoid valve. The controller controls an opening degree of the boom-raising proportional solenoid valve based on the pressure detected by the second pressure sensor. The amount of increase in current per unit time when the controller outputs, to the boom-lowering proportional solenoid valve, the instruction signal for instructing an increase in opening degree is smaller than an amount of increase in current per unit time when the controller outputs, to the boom-raising proportional solenoid valve, an instruction signal for instructing an increase in opening degree. Thus, the response speed of the boom-lowering operation can be decreased while maintaining the response speed of the boom-raising operation.

The hydraulic excavator further includes a bucket having a cutting edge. The controller controls the boom to prevent a position of the cutting edge from becoming lower than construction design data. Thus, the land leveling work can be performed in accordance with the construction design data, and therefore, the quality and efficiency of the land leveling work with the hydraulic excavator can be enhanced.

In the hydraulic excavator, the controller transmits and receives information to and from the outside by satellite communication. Thus, the information-oriented construction based on the information transmitted and received to and from the outside becomes possible, and the highly-efficient and highly-accurate land leveling work with the hydraulic excavator can be realized.

Advantageous Effects of Invention

As described above, according to the present invention, even when the vehicle body shakes after the work implement stops automatically, in the case of aligning the cutting edge of the bucket with the design surface, it is possible to suppress execution of boom-lowering again when the cutting edge temporarily moves upwardly away from the design surface. Therefore, it is possible to prevent the problem that the cutting edge is located lower than the design surface and the design surface is invaded after the shake of the vehicle body stops.

DESCRIPTION OF EMBODIMENTS

An embodiment of the present invention will be described hereinafter with reference to the drawings.

First, a configuration of a hydraulic excavator to which an idea of the present invention is applicable will be described.

Figure 1:
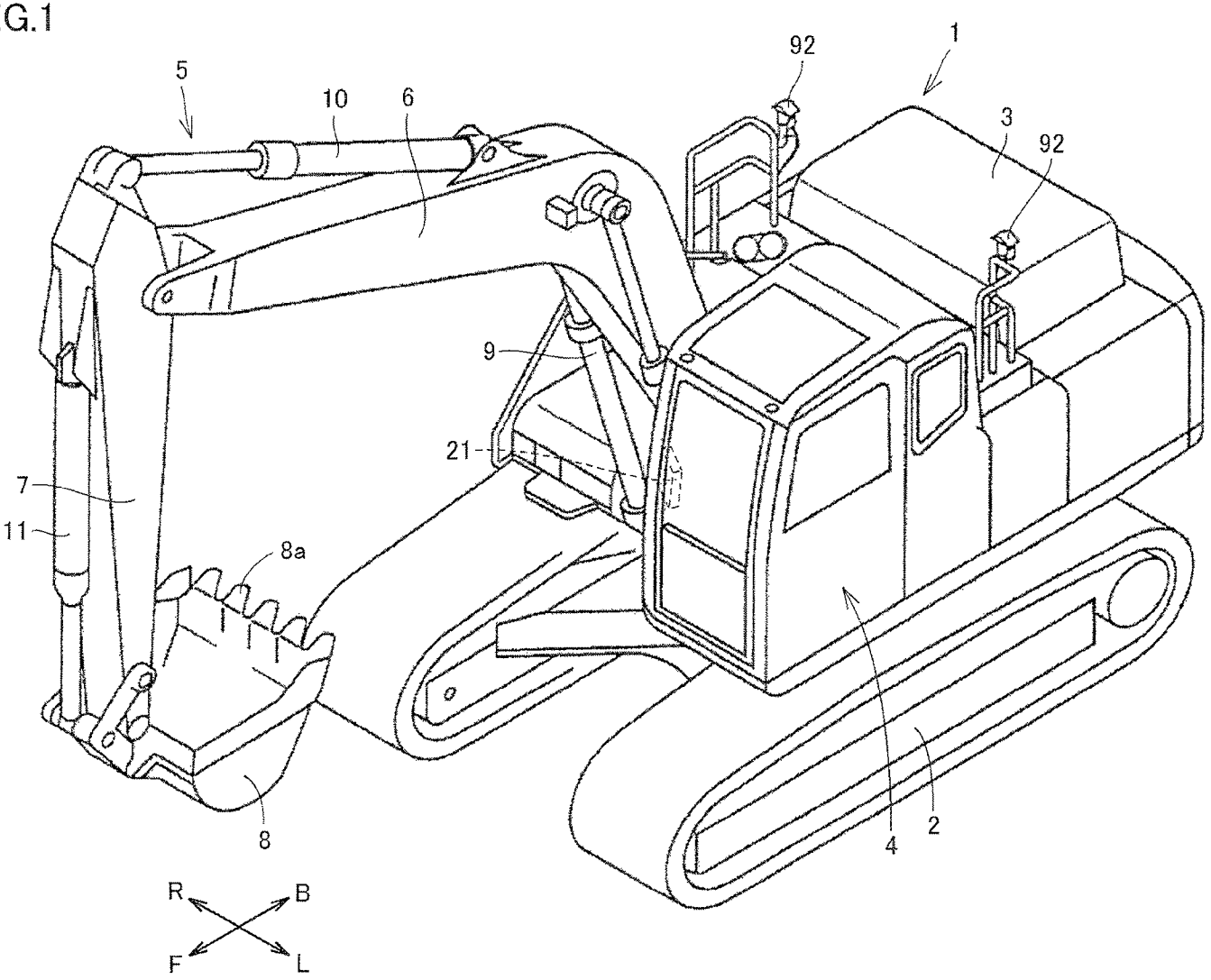
FIG. 1 is a schematic perspective view showing a configuration of a hydraulic excavator according to one embodiment of the present invention.

FIG. 1 is a schematic perspective view showing a configuration of a hydraulic excavator 1 according to one embodiment of the present invention. As shown in FIG. 1, hydraulic excavator 1 mainly includes an undercarriage 2, an upper revolving unit 3 and a work implement 5. Undercarriage 2 and upper revolving unit 3 constitute a work vehicle main body.

Undercarriage 2 has a pair of left and right crawler belts. It is configured to allow hydraulic excavator 1 to be self-propelled by rotation of the pair of crawler belts. Upper revolving unit 3 is disposed to be pivotable with respect to undercarriage 2.

Upper revolving unit 3 includes a cab 4 that is a space for an operator to operate hydraulic excavator 1. Cab 4 is included in the work vehicle main body. On the backward side B, upper revolving unit 3 includes an engine compartment that houses an engine, and a counter weight. In the present embodiment, the frontward side (front side) of the operator when seated in cab 4 will be referred to as frontward side F of upper revolving unit 3, and the side opposite to frontward side F, i.e., the backward side of the operator will be referred to as backward side B of upper revolving unit 3. The left side of the operator when seated will be referred to as left side L of upper revolving unit 3, and the right side of the operator when seated will be referred to as right side R of upper revolving unit 3. In the following description, it is assumed that the frontward-backward and left-right directions of upper revolving unit 3 match the frontward-backward and left-right directions of hydraulic excavator 1.

Work implement 5 that performs works such as soil excavation is pivotably supported by upper revolving unit 3 so as to be operable in the upward-downward direction. Work implement 5 has a boom 6 attached to a substantially central portion on frontward side F of upper revolving unit 3 so as to be operable in the upward-downward direction, an arm 7 attached to a tip of boom 6 so as to be operable in the backward-frontward direction, and a bucket 8 attached to a tip of arm 7 so as to be operable in the backward-frontward direction. Bucket 8 has a cutting edge 8*a* at a tip thereof. Boom 6, arm 7 and bucket 8 are configured to be driven by a boom cylinder 9, an arm cylinder 10 and a bucket cylinder 11 that are hydraulic cylinders, respectively.

Cab 4 is arranged on frontward side F and on left side L of upper revolving unit 3. With respect to cab 4, work implement 5 is provided on right side R that is one side portion side of cab 4. It should be noted that the arrangement of cab 4 and work implement 5 is not limited to the example shown in FIG. 1, and work implement 5 may be provided, for example, on the left side of cab 4 arranged on the frontward right side of upper revolving unit 3.

Figure 2:
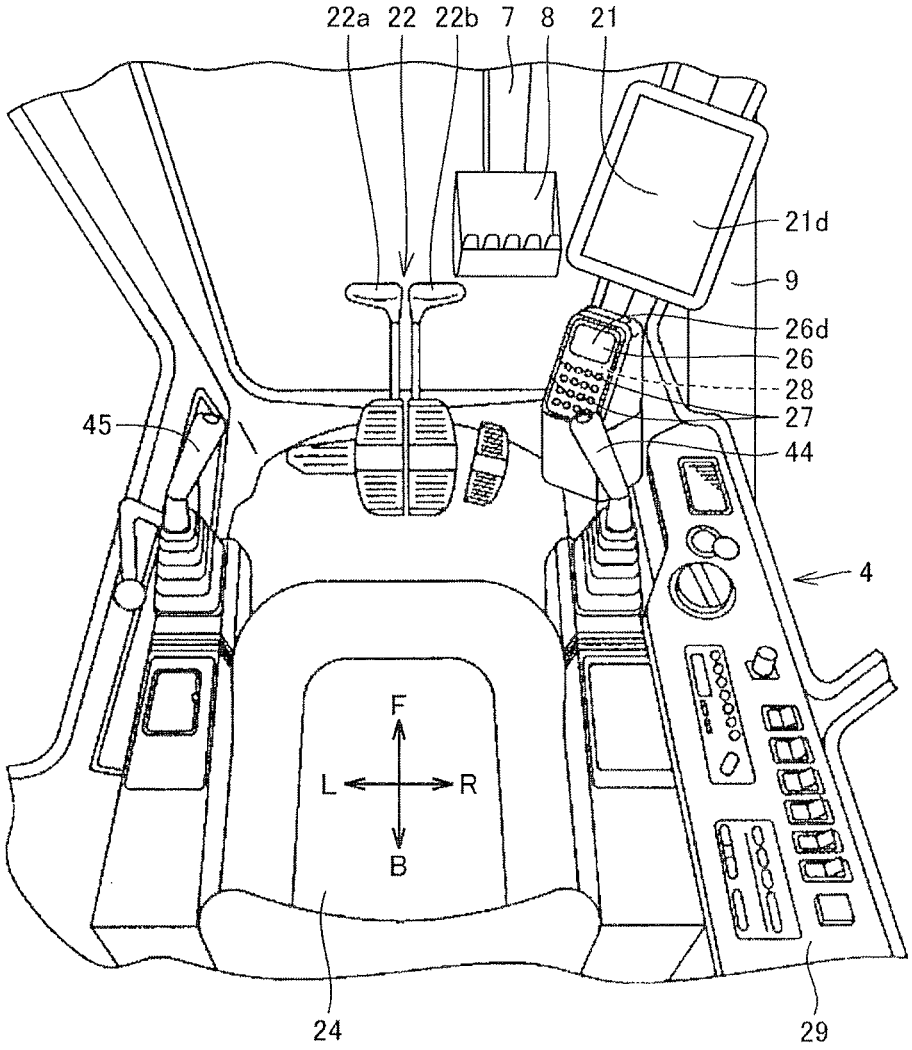
FIG. 2 is a perspective view of the inside of a cab of the hydraulic excavator.

FIG. 2 is a perspective view of the inside of cab 4 of hydraulic excavator 1. As shown in FIG. 2, an operator's seat 24 on which the operator facing toward frontward side F is seated is arranged inside cab 4. Cab 4 includes a roof portion arranged to cover operator's seat 24, and a plurality of pillars supporting the roof portion. The plurality of pillars have a front pillar arranged on frontward side F with respect to operator's seat 24, a rear pillar arranged on backward side B with respect to operator's seat 24, and an intermediate pillar arranged between the front pillar and the rear pillar. Each pillar extends along a vertical direction orthogonal to a horizontal surface, and is coupled to a floor portion and the roof portion of cab 4.

A space surrounded by each pillar and the floor and roof portions of cab 4 forms an interior space of cab 4. Operator's seat 24 is housed in the interior space of cab 4 and is arranged at a substantially center of the floor portion of cab 4. A side surface on left side L of cab 4 is provided with a door for the operator to get in or out of cab 4.

A front window is arranged on frontward side F with respect to operator's seat 24. The front window is made of a transparent material and the operator seated on operator's seat 24 can view the outside of cab 4 through the front window. For example, as shown in FIG. 2, the operator seated on operator's seat 24 can directly view bucket 8 excavating soil through the front window.

A monitor device 26 is disposed on frontward side F inside cab 4. Monitor device 26 is arranged at a corner on the frontward right side inside cab 4, and is supported by a support extending from the floor portion of cab 4. Monitor device 26 is arranged on the operator's seat 24 side with respect to the front pillar. Monitor device 26 is arranged in front of the front pillar when viewed from the operator seated on operator's seat 24.

For multipurpose use, monitor device 26 includes a planar display surface 26*d* having various monitor functions, a switch unit 27 having a plurality of switches to which many functions are assigned, and a sound generator 28 that expresses by sound the contents displayed on display surface 26*d*. This display surface 26*d* is configured by a graphic indicator such as a liquid crystal indicator and an organic EL indicator. Although switch unit 27 includes a plurality of key switches, the present invention is not limited thereto. Switch unit 27 may include touch panel-type touch switches.

Travel control levers (left and right travel control levers) 22*a* and 22*b* for the left and right crawler belts are provided on frontward side F of operator's seat 24. Left and right travel control levers 22*a* and 22*b* form a travel control unit 22 for controlling undercarriage 2.

A first control lever 44 for the operator on cab 4 to control driving of boom 6 and bucket 8 of work implement 5 is provided on right side R of operator's seat 24. A switch panel 29 having various switches and the like mounted thereon is also provided on right side R of operator's seat 24. A second control lever 45 for the operator to control driving of arm 7 of work implement 5 and revolving of upper revolving unit 3 is provided on left side L of operator's seat 24.

A monitor 21 is arranged above monitor device 26. Monitor 21 has a planar display surface 21*d*. Comparing display surface 26*d* of monitor device 26 and display surface 21*d* of monitor 21 shown in FIG. 2, display surface 21*d* is provided to be larger than display surface 26*d*. For example, monitor device 26 may have 7-inch display surface 26*d*, and monitor 21 may have 12-inch display surface 21*d*.

Monitor 21 is attached to the front pillar on right side R, which is the side close to work implement 5, of the pair of front pillars. Monitor 21 is arranged in front of the front pillar in the line of sight of the operator seated on operator's seat 24 toward the frontward right direction. By attaching monitor 21 to the front pillar on right side R in hydraulic excavator 1 including work implement 5 on right side R of cab 4, the operator can view both work implement 5 and monitor 21 with a small amount of line-of-sight movement.

Figure 3:
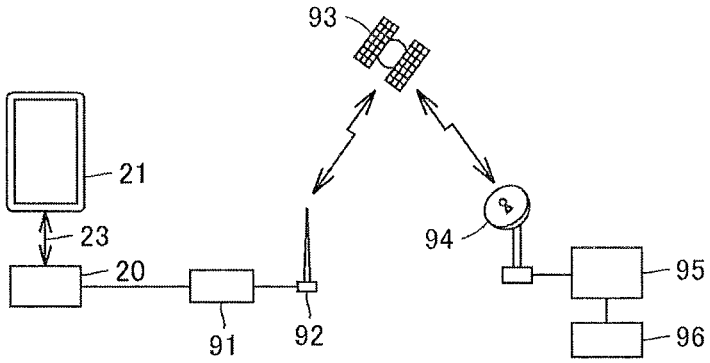
FIG. 3 is a schematic view showing a schematic configuration for transmitting and receiving information to and from the hydraulic excavator.

FIG. 3 is a schematic view showing a schematic configuration for transmitting and receiving information to and from hydraulic excavator 1. Hydraulic excavator 1 includes a controller 20. Controller 20 has a function of controlling operation of work implement 5, revolving of upper revolving unit 3, travel driving of undercarriage 2, and the like. Controller 20 and monitor 21 are connected by a bidirectional network communication cable 23 and form a communication network inside hydraulic excavator 1. Monitor 21 and controller 20 can mutually transmit and receive information via network communication cable 23. Each of monitor 21 and controller 20 is configured mainly by a computer device such as a microcomputer.

Information can be transmitted and received between controller 20 and an external monitoring station 96. In the present embodiment, controller 20 and monitoring station 96 communicate with each other by satellite communication. A communication terminal 91 having a satellite communication antenna 92 is connected to controller 20. As shown in FIG. 1, satellite communication antenna 92 is mounted on upper revolving unit 3. A network control station 95 linked by a dedicated line to a communication earth station 94 communicating with a communication satellite 93 by a dedicated communication line is connected to monitoring station 96 on the ground via the Internet and the like. As a result, data is transmitted and received between controller 20 and prescribed monitoring station 96 via communication terminal 91, communication satellite 93, communication earth station 94, and network control station 95.

An example of applying the information-oriented construction system to hydraulic excavator 1 according to the present embodiment will be described. Construction design data created by a three-dimensional CAD (Computer Aided Design) is prestored in controller 20. Monitor 21 updates and displays the externally-received current position of hydraulic excavator 1 on the screen in real time, such that the operator can constantly check the work state of hydraulic excavator 1.

Controller 20 compares the construction design data with the position and posture of work implement 5 in real time, and drives a hydraulic circuit based on the result of comparison, thereby controlling work implement 5. More specifically, controller 20 compares the position for construction based on the construction design data (design surface) with the position of bucket 8, and executes control to prevent cutting edge 8*a* of bucket 8 from being located lower than the design surface to prevent deeper excavation than the design surface. As a result, the construction efficiency and the construction accuracy can be enhanced, and high-quality construction can be easily performed.

Figure 4:
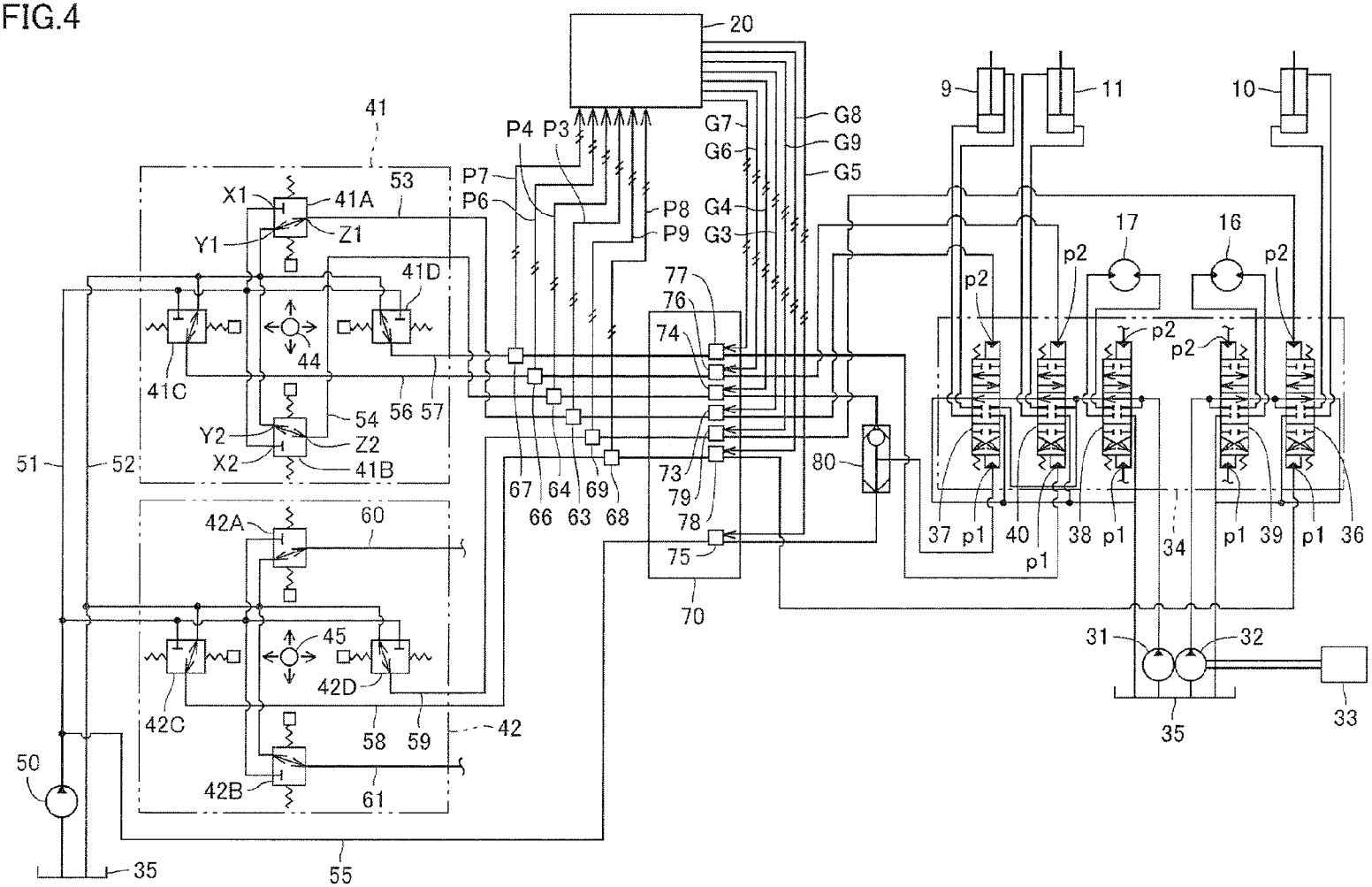
FIG. 4 is a hydraulic circuit diagram applied to the hydraulic excavator.

FIG. 4 is a hydraulic circuit diagram applied to hydraulic excavator 1. In a hydraulic system according to the present embodiment shown in FIG. 4, a first hydraulic pump 31 and a second hydraulic pump 32 are driven by an engine 33. First hydraulic pump 31 and second hydraulic pump 32 serve as a driving source for driving a hydraulic actuator such as boom cylinder 9, arm cylinder 10, bucket cylinder 11, travel motors 16 and 17, and the like. The hydraulic oil discharged from first hydraulic pump 31 and second hydraulic pump 32 is supplied to the hydraulic actuator via a main operation valve 34. The hydraulic oil supplied to the hydraulic actuator is discharged to a tank 35 via main operation valve 34.

Main operation valve 34 has a pilot switching valve for the arm 36, a pilot switching valve for the boom 37, a pilot switching valve for left travel 38, a pilot switching valve for right travel 39, and a pilot switching valve for the bucket 40. Pilot switching valve for the arm 36 controls supply and discharge of the hydraulic oil to and from arm cylinder 10. Pilot switching valve for the boom 37 controls supply and discharge of the hydraulic oil to and from boom cylinder 9. Pilot switching valve for left travel 38 controls supply and discharge of the hydraulic oil to and from left travel motor 17. Pilot switching valve for right travel 39 controls supply and discharge of the hydraulic oil to and from right travel motor 16. Pilot switching valve for the bucket 40 controls supply and discharge of the hydraulic oil to and from bucket cylinder 11.

Each of pilot switching valve for the arm 36, pilot switching valve for the boom 37, pilot switching valve for left travel 38, pilot switching valve for right travel 39, and pilot switching valve for the bucket 40 has a pair of pilot ports p1 and p2. In accordance with the pressure (pilot pressure) of the oil supplied to each of pilot ports p1 and p2, each of pilot switching valves 36 to 40 is controlled.

The pilot pressures applied to pilot ports p1 and p2 of pilot switching valve for the arm 36, pilot switching valve for the boom 37 and pilot switching valve for the bucket 40 are controlled by operating a first control lever device 41 and a second control lever device 42. The pilot pressures applied to pilot switching valve for left travel 38 and pilot switching valve for right travel 39 are controlled by operating left and right travel control levers 22*a* and 22*b* shown in FIG. 2. The operator operates first control lever device 41 and second control lever device 42, thereby controlling the operation of work implement 5 and the revolving operation of upper revolving unit 3. The operator operates left and right travel control levers 22*a* and 22*b*, thereby controlling the travelling operation of undercarriage 2.

First control lever device 41 has first control lever 44 operated by the operator, a first pilot pressure control valve 41A, a second pilot pressure control valve 41B, a third pilot pressure control valve 41C, and a fourth pilot pressure control valve 41D. First pilot pressure control valve 41A, second pilot pressure control valve 41B, third pilot pressure control valve 41C, and fourth pilot pressure control valve 41D are provided to correspond to the four directions, i.e., the frontward-backward and left-right directions, of first control lever 44.

Second control lever device 42 has second control lever 45 operated by the operator, a fifth pilot pressure control valve 42A, a sixth pilot pressure control valve 42B, a seventh pilot pressure control valve 42C, and an eighth pilot pressure control valve 42D. Fifth pilot pressure control valve 42A, sixth pilot pressure control valve 42B, seventh pilot pressure control valve 42C, and eighth pilot pressure control valve 42D are provided to correspond to the four directions, i.e., the frontward-backward and left-right directions, of second control lever 45.

Pilot pressure control valves 41A to 41D and 42A to 42D for controlling driving of hydraulic cylinders 9, 10 and 11 for work implement 5 as well as a swing motor are connected to first control lever 44 and second control lever 45, respectively. Pilot pressure control valves for controlling driving of right and left travel motors 16 and 17 are connected to left and right travel control levers 22*a* and 22*b*, respectively.

First pilot pressure control valve 41A has a first pump port X1, a first tank port Y1 and a first supply/discharge port Z1. First pump port X1 is connected to a pump flow path 51. First tank port Y1 is connected to a tank flow path 52. Pump flow path 51 and tank flow path 52 are connected to tank 35 that stores the hydraulic oil. A third hydraulic pump 50 is provided in pump flow path 51. Third hydraulic pump 50 is different from first hydraulic pump 31 and second hydraulic pump 32 described above. However, instead of third hydraulic pump 50, first hydraulic pump 31 or second hydraulic pump 32 may be used. First supply/discharge port Z1 is connected to a first pilot conduit 53.

In accordance with the operation of first control lever 44, first pilot pressure control valve 41A is switched between an output state and a discharge state. In the output state, first pilot pressure control valve 41A causes first pump port X1 and first supply/discharge port Z1 to communicate with each other, and outputs the hydraulic oil having a pressure corresponding to an amount of operation of first control lever 44 from first supply/discharge port Z1 to first pilot conduit 53. In the discharge state, first pilot pressure control valve 41A causes first tank port Y1 and first supply/discharge port Z1 to communicate with each other.

Second pilot pressure control valve 41B has a second pump port X2, a second tank port Y2 and a second supply/discharge port Z2. Second pump port X2 is connected to pump flow path 51. Second tank port Y2 is connected to tank flow path 52. Second supply/discharge port Z2 is connected to a second pilot conduit 54.

In accordance with the operation of first control lever 44, second pilot pressure control valve 41B is switched between an output state and a discharge state. In the output state, second pilot pressure control valve 41B causes second pump port X2 and second supply/discharge port Z2 to communicate with each other, and outputs the hydraulic oil having a pressure corresponding to an amount of operation of first control lever 44 from second supply/discharge port Z2 to second pilot conduit 54. In the discharge state, second pilot pressure control valve 41B causes second tank port Y2 and second supply/discharge port Z2 to communicate with each other.

First pilot pressure control valve 41A and second pilot pressure control valve 41B form a pair and correspond to the operation directions of first control lever 44 that are opposite to each other. For example, first pilot pressure control valve 41A corresponds to the operation of first control lever 44 toward the frontward direction, and second pilot pressure control valve 41B corresponds to the operation of first control lever 44 toward the backward direction. Either first pilot pressure control valve 41A or second pilot pressure control valve 41B is selected in accordance with the operation of first control lever 44. When first pilot pressure control valve 41A is in the output state, second pilot pressure control valve 41B is in the discharge state. When first pilot pressure control valve 41A is in the discharge state, second pilot pressure control valve 41B is in the output state.

First pilot pressure control valve 41A controls supply and discharge of the hydraulic oil to and from second pilot port p2 of pilot switching valve for the boom 37. Second pilot pressure control valve 41B controls supply and discharge of the hydraulic oil to and from first pilot port p1 of pilot switching valve for the boom 37. In accordance with the operation of first control lever 44, supply and discharge of the hydraulic oil to and from boom cylinder 9 are controlled, and extension and contraction of boom cylinder 9 are controlled. As a result, the operation for raising or lowering boom 6 is controlled in accordance with the operation of first control lever 44.

First pilot port p1 of pilot switching valve for the boom 37 has a function as a boom-raising pilot port supplied with the hydraulic oil at the time of the operation for raising boom 6. Second pilot port p2 of pilot switching valve for the boom 37 has a function as a boom-lowering pilot port supplied with the hydraulic oil at the time of the operation for lowering boom 6.

The pilot pressure supplied to first pilot conduit 53 via first pilot pressure control valve 41A is detected by a hydraulic pressure sensor 63. Hydraulic pressure sensor 63 outputs, to controller 20, a pressure signal P3 that is an electric detection signal corresponding to the detected pilot pressure. In addition, the pilot pressure supplied to second pilot conduit 54 via second pilot pressure control valve 41B is detected by a hydraulic pressure sensor 64. Hydraulic pressure sensor 64 outputs, to controller 20, a pressure signal P4 that is an electric detection signal corresponding to the detected pilot pressure.

A relay block 70 is provided in a hydraulic pressure path connecting first and second control lever devices 41 and 42 and main operation valve 34. Relay block 70 is configured to include a plurality of proportional solenoid valves 73 to 79. Proportional solenoid valve 73 is provided in first pilot conduit 53. Hydraulic pressure sensor 63 is provided between first pilot pressure control valve 41A and proportional solenoid valve 73 in first pilot conduit 53. Proportional solenoid valve 74 is provided in second pilot conduit 54. Hydraulic pressure sensor 64 is provided between second pilot pressure control valve 41B and proportional solenoid valve 74 in second pilot conduit 54. Proportional solenoid valves 73 and 74 are provided to control the operation for moving boom 6 upwardly and downwardly in accordance with the operation of first control lever 44.

Based on the pilot pressure of first pilot conduit 53 detected by hydraulic pressure sensor 63, controller 20 controls proportional solenoid valve 73. Hydraulic pressure sensor 63 has a function as a first pressure sensor for detecting the hydraulic pressure generated in first pilot conduit 53 between first pilot pressure control valve 41A and proportional solenoid valve 73 in accordance with the operation of first control lever 44. In accordance with the hydraulic pressure detected by hydraulic pressure sensor 63, controller 20 outputs an instruction signal G3 to proportional solenoid valve 73 and adjusts the opening degree thereof, thereby changing a flow rate of the hydraulic oil flowing through first pilot conduit 53, and controlling the hydraulic pressure transmitted to second pilot port p2 of pilot switching valve for the boom 37.

Based on the hydraulic pressure detected by hydraulic pressure sensor 63, controller 20 controls the opening degree of proportional solenoid valve 73 and outputs, to proportional solenoid valve 73, an instruction signal for instructing boom-lowering. In accordance with the degree of the hydraulic pressure transmitted to second pilot port p2, the speed of boom 6 when lowered is adjusted.

In addition, based on the pilot pressure of second pilot conduit 54 detected by hydraulic pressure sensor 64, controller 20 controls proportional solenoid valve 74. Hydraulic pressure sensor 64 has a function as a second pressure sensor for detecting the hydraulic pressure generated in second pilot conduit 54 between second pilot pressure control valve 41B and proportional solenoid valve 74 in accordance with the operation of first control lever 44. In accordance with the hydraulic pressure detected by hydraulic pressure sensor 64, controller 20 outputs an instruction signal. G4 to proportional solenoid valve 74 and adjusts the opening degree thereof, thereby changing a flow rate of the hydraulic oil flowing through second pilot conduit 54, and controlling the hydraulic pressure transmitted to first pilot port p1 of pilot switching valve for the boom 37.

Based on the hydraulic pressure detected by hydraulic pressure sensor 64, controller 20 controls the opening degree of proportional solenoid valve 74 and outputs, to proportional solenoid valve 74, an instruction signal for instructing boom-raising. In accordance with the degree of the hydraulic pressure transmitted to first pilot port p1, the speed of boom 6 when raised is adjusted.

A shuttle valve 80 is provided in second pilot conduit 54. Shuttle valve 80 has two entrance ports and one exit port. The exit port of shuttle valve 80 is connected to first pilot port p1 of pilot switching valve for the boom 37 via second pilot conduit 54. One entrance port of shuttle valve 80 is connected to second pilot pressure control valve 41B via second pilot conduit 54. The other entrance port of shuttle valve 80 is connected to a pump flow path 55.

Pump flow path 55 branches off from pump flow path 51. One end of pump flow path 55 is connected to pump flow path 51 and the other end of pump flow path 55 is connected to shuttle valve 80. The hydraulic oil transported by third hydraulic pump 50 flows to first control lever device 41 and second control lever device 42 via pump flow path 51, and also flows to shuttle valve 80 via pump flow paths 51 and 55.

Shuttle valve 80 is a shuttle valve of higher pressure priority type. Shuttle valve 80 compares the hydraulic pressure in second pilot conduit 54 connected to one entrance port and the hydraulic pressure in pump flow path 55 connected to the other entrance port, and selects the higher pressure. Shuttle valve 80 causes a higher pressure-side flow path of second pilot conduit 54 and pump flow path 55 to communicate with the exit port, and supplies the hydraulic oil flowing through this higher pressure-side flow path to first pilot port p1 of pilot switching valve for the boom 37.

A proportional solenoid valve 75 included in relay block. 70 is provided in pump flow path 55. Proportional solenoid valve 75 is a valve for forcible boom-raising intervention. Proportional solenoid valve 75 receives an instruction signal G5 outputted from controller 20, and adjusts the opening degree thereof. Regardless of the operation of first control lever device 41 by the operator, controller 20 outputs instruction signal G5 to proportional solenoid valve 75 and adjusts the opening degree thereof, thereby changing a flow rate of the hydraulic oil flowing through pump flow path 55, and controlling the hydraulic pressure transmitted to first pilot port p1 of pilot switching valve for the boom 37. By adjustment of the opening degree of proportional solenoid valve 75, controller 20 controls the operation for forcibly raising boom 6.

Third pilot pressure control valve 41C and fourth pilot pressure control valve 41D have configurations similar to those of first pilot pressure control valve 41A and second pilot pressure control valve 41B described above. Similarly to first pilot pressure control valve 41A and second pilot pressure control valve 41B, third pilot pressure control valve 41C and fourth pilot pressure control valve 41D form a pair, and either third pilot pressure control valve 41C or fourth pilot pressure control valve 41D is selected in accordance with the operation of first control lever 44. For example, third pilot pressure control valve 41C corresponds to the operation of first control lever 44 toward the left direction, and fourth pilot pressure control valve 41D corresponds to the operation of first control lever 44 toward the right direction.

Third pilot pressure control valve 41C is connected to pump flow path 51, tank flow path 52 and a third pilot conduit 56. Third pilot pressure control valve 41C controls supply and discharge of the hydraulic oil to and from second pilot port p2 of pilot switching valve for the bucket 40. Fourth pilot pressure control valve 41D is connected to pump flow path 51, tank flow path 52 and a fourth pilot conduit 57. Fourth pilot pressure control valve 41D controls supply and discharge of the hydraulic oil to and from first pilot port p1 of pilot switching valve for the bucket 40. In accordance with the operation of first control lever 44, supply and discharge of the hydraulic oil to and from bucket cylinder 11 are controlled, and extension and contraction of bucket cylinder 11 are controlled. As a result, the operation of bucket 8 toward the excavation direction or the open direction is controlled in accordance with the operation of first control lever 44.

The pressure (pilot pressure) of the hydraulic oil supplied to third pilot conduit 56 via third pilot pressure control valve 41C is detected by a hydraulic pressure sensor 66. Hydraulic pressure sensor 66 outputs, to controller 20, a pressure signal P6 corresponding to the detected pilot pressure of the hydraulic oil. A proportional solenoid valve 76 is provided in third pilot conduit 56 connecting third pilot pressure control valve 41C and second pilot port p2 of pilot switching valve for the bucket 40. In accordance with the hydraulic pressure detected by hydraulic pressure sensor 66, controller 20 outputs an instruction signal G6 to proportional solenoid valve 76, and controls the hydraulic pressure transmitted to second pilot port p2 of pilot switching valve for the bucket 40. In accordance with the degree of the hydraulic pressure transmitted to second pilot port p2, the speed of bucket 8 when moved toward the excavation direction is adjusted.

The pressure (pilot pressure) of the hydraulic oil supplied to fourth pilot conduit 57 via fourth pilot pressure control valve 41D is detected by a hydraulic pressure sensor 67. Hydraulic pressure sensor 67 outputs, to controller 20, a pressure signal P7 corresponding to the detected pilot pressure of the hydraulic oil. A proportional solenoid valve 77 is provided in fourth pilot conduit 57 connecting fourth pilot pressure control valve 41D and first pilot port p1 of pilot switching valve for the bucket 40. In accordance with the hydraulic pressure detected by hydraulic pressure sensor 67, controller 20 outputs an instruction signal G7 to proportional solenoid valve 77, and controls the hydraulic pressure transmitted to first pilot port p1 of pilot switching valve for the bucket 40. In accordance with the degree of the hydraulic pressure transmitted to first pilot port p1, the speed of bucket 8 when moved toward the open direction is adjusted.

Fifth pilot pressure control valve 42A, sixth pilot pressure control valve 42B, seventh pilot pressure control valve 42C, and eighth pilot pressure control valve 42D have configurations similar to those of first pilot pressure control valve 41A, second pilot pressure control valve 41B, third pilot pressure control valve 41C, and fourth pilot pressure control valve 41D described above. Fifth pilot pressure control valve 42A and sixth pilot pressure control valve 42B form a pair, and either fifth pilot pressure control valve 42A or sixth pilot pressure control valve 42B is selected in accordance with the operation of second control lever 45. Seventh pilot pressure control valve 42C and eighth pilot pressure control valve 42D form a pair, and either seventh pilot pressure control valve 42C or eighth pilot pressure control valve 42D is selected in accordance with the operation of second control lever 45.

For example, fifth pilot pressure control valve 42A corresponds to the operation of second control lever 45 toward the frontward direction, and sixth pilot pressure control valve 42B corresponds to the operation of second control lever 45 toward the backward direction. Seventh pilot pressure control valve 42C corresponds to the operation of second control lever 45 toward the left direction, and eighth pilot pressure control valve 42D corresponds to the operation of second control lever 45 toward the right direction.

Fifth pilot pressure control valve 42A is connected to pump flow path 51, tank flow path 52 and a fifth pilot conduit 60. Sixth pilot pressure control valve 42B is connected to pump flow path 51, tank flow path 52 and a sixth pilot conduit 61. A not-shown electric motor for revolving upper revolving unit 3 is controlled based on the pressure of the hydraulic oil supplied to fifth pilot conduit 60 via fifth pilot pressure control valve 42A and the pressure of the hydraulic oil supplied to sixth pilot conduit 61 via sixth pilot pressure control valve 42B. Rotational driving of this electric motor when the hydraulic oil is supplied to fifth pilot conduit 60 is opposite to rotational driving of the electric motor when the hydraulic oil is supplied to sixth pilot conduit 61. In accordance with the direction of operation and the amount of operation of second control lever 45, the revolving direction and the revolving speed of upper revolving unit 3 are controlled.

Seventh pilot pressure control valve 42C is connected to pump flow path 51, tank flow path 52 and a seventh pilot conduit 58. Seventh pilot pressure control valve 42C controls supply and discharge of the hydraulic oil to and from first pilot port p1 of pilot switching valve for the arm 36. Eighth pilot pressure control valve 42D is connected to pump flow path 51, tank flow path 52 and an eighth pilot conduit 59. Eighth pilot pressure control valve 42D controls supply and discharge of the hydraulic oil to and from second pilot port p2 of pilot switching valve for the arm 36. In accordance with the operation of second control lever 45, supply and discharge of the hydraulic oil to and from arm cylinder 10 are controlled, and extension and contraction of arm cylinder 10 are controlled. As a result, the operation for relatively rotating arm 7 with respect to boom 6 is controlled in accordance with the operation of second control lever 45.

The pressure (pilot pressure) of the hydraulic oil supplied to seventh pilot conduit 58 via seventh pilot pressure control valve 42C is detected by a hydraulic pressure sensor 68. Hydraulic pressure sensor 68 outputs, to controller 20, a pressure signal P8 corresponding to the detected pilot pressure of the hydraulic oil. A proportional solenoid valve 78 is provided in seventh pilot conduit 58 connecting seventh pilot pressure control valve 42C and first pilot port p1 of pilot switching valve for the arm 36. In accordance with the hydraulic pressure detected by hydraulic pressure sensor 68, controller 20 outputs an instruction signal G8 to proportional solenoid valve 78, and controls the hydraulic pressure transmitted to first pilot port p1 of pilot switching valve for the arm 36. In accordance with the degree of the hydraulic pressure transmitted to first pilot port p1, the speed of arm 7 when moved toward the direction of extending arm 7, i.e., toward the direction in which arm 7 moves away from upper revolving unit 3, is adjusted.

The pressure (pilot pressure) of the hydraulic oil supplied to eighth pilot conduit 59 via eighth pilot pressure control valve 42D is detected by a hydraulic pressure sensor 69. Hydraulic pressure sensor 69 outputs, to controller 20, a pressure signal P9 corresponding to the detected pilot pressure of the hydraulic oil. A proportional solenoid valve 79 is provided in eighth pilot conduit 59 connecting eighth pilot pressure control valve 42D and second pilot port p2 of pilot switching valve for the arm 36. In accordance with the hydraulic pressure detected by hydraulic pressure sensor 69, controller 20 outputs an instruction signal G9 to proportional solenoid valve 79, and controls the hydraulic pressure transmitted to second pilot port p2 of pilot switching valve for the arm 36. In accordance with the degree of the hydraulic pressure transmitted to second pilot port p2, the speed of arm 7 when moved toward the direction of bending arm 7, i.e., toward the direction in which arm 7 comes closer to upper revolving unit 3, is adjusted.

The setting of a correspondence relationship between the operation directions of first and second control levers 44 and 45 and the operation of work implement 5 and the revolving operation of upper revolving unit 3 may be switchable to desired patterns. For example, first pilot pressure control valve 41A and second pilot pressure control valve 41B may correspond to the operations of first control lever 44 toward the frontward and backward directions, respectively, or may correspond to the operations of first control lever 44 toward the left and right directions, respectively.

Figure 5:
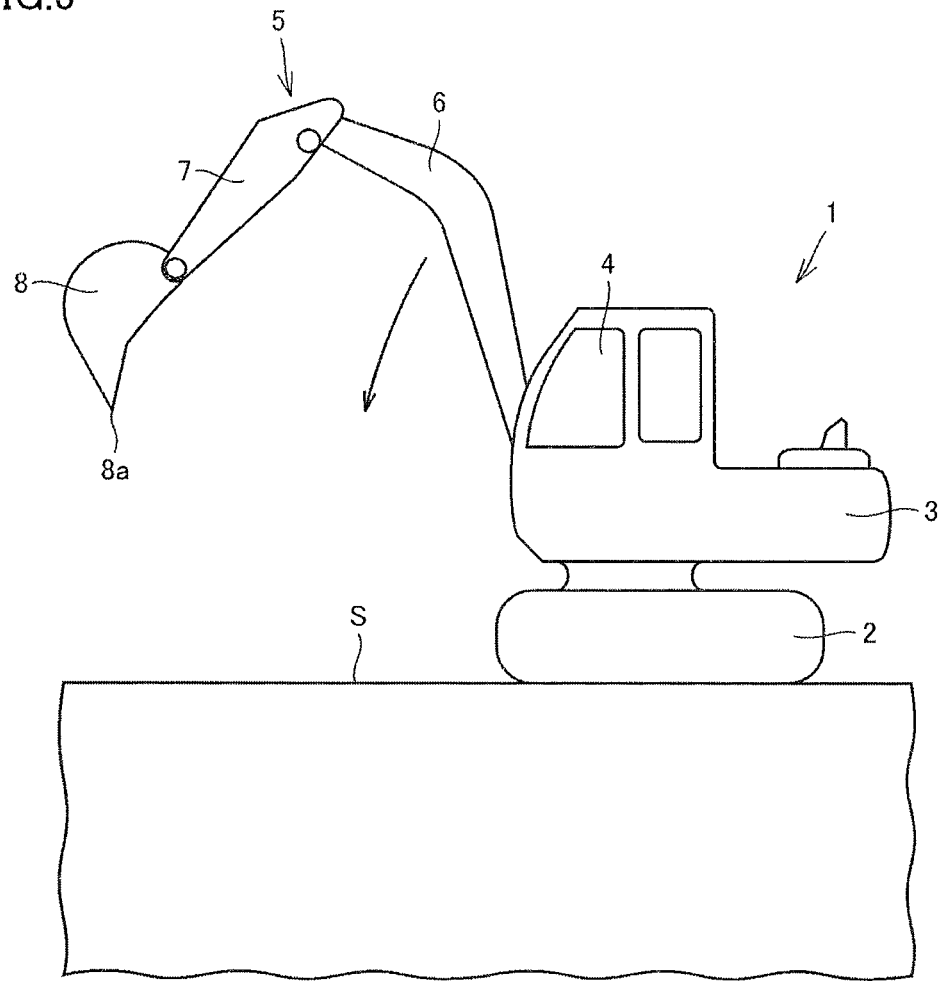
FIG. 5 is a schematic view before a work implement is aligned in a land leveling work with the hydraulic excavator.
Figure 6:
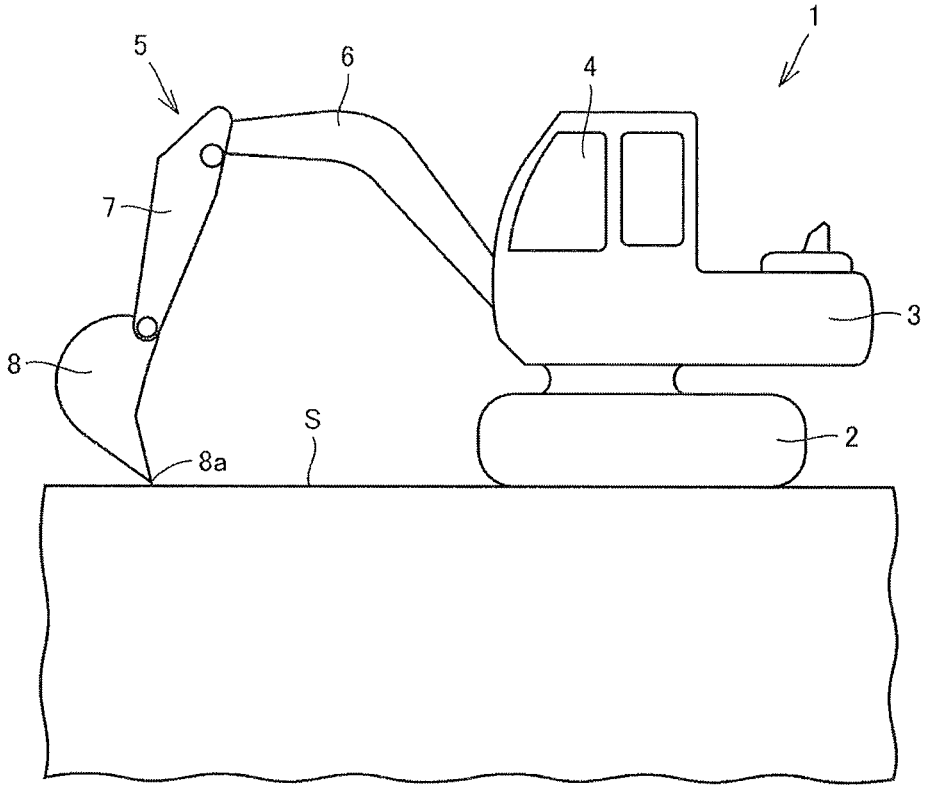
FIG. 6 is a schematic view after the work implement is aligned in the land leveling work with the hydraulic excavator.

The land leveling work with hydraulic excavator 1 having the aforementioned configuration will be described below. FIG. 5 is a schematic view before work implement 5 is aligned in the land leveling work with hydraulic excavator 1. FIG. 6 is a schematic view after work implement 5 is aligned in the land leveling work with hydraulic excavator 1. A design surface S shown in FIGS. 5 and 6 represents a target landform in accordance with the construction design data prestored in controller 20 (FIG. 4). Controller 20 controls work implement 5 based on the construction design data and the current positional information of work implement 5.

When cutting edge 8*a* of bucket 8 is aligned with design surface S from the state in which work implement 5 is located above design surface S as shown in FIG. 5, the operator operating work implement 5 continues to operate first control lever 44 toward the first pilot pressure control valve 41A side and performs the operation for lowering boom 6. In accordance with this operator's operation, boom 6 is lowered and cutting edge 8*a* of bucket 8 comes closer to design surface S as shown by an arrow in FIG. 5.

In order to avoid cutting edge 8*a* of bucket 8 from moving to be lower than design surface S and cutting into design surface S, control for automatically stopping the operation of work implement 5 at a position where cutting edge 8*a* comes into contact with design surface S is executed. When it is expected that cutting edge 8*a* of bucket 8 will move to be lower than design surface S, controller 20 executes stop control for automatically stopping boom 6 to prevent cutting edge 8*a* of bucket 8 from becoming lower than design surface S. At this time, controller 20 outputs instruction signal G3 for decreasing the opening degree of proportional solenoid valve 73. As a result, proportional solenoid valve 73 that has been in the open state enters the fully-closed state. As described above, cutting edge 8*a* of bucket 8 is aligned with design surface S as shown in FIG. 6.

First pilot conduit 53 has a function as a boom-lowering pilot conduit connected to second pilot port p2 of pilot switching valve for the boom 37. Second pilot conduit 54 and pump flow path 55 have a function as a boom-raising pilot conduit connected to first pilot port p1 of pilot switching valve for the boom 37 via shuttle valve 80. Proportional solenoid valve 73 provided in first pilot conduit 53 has a function as a boom-lowering proportional solenoid valve. Proportional solenoid valve 74 provided in second pilot conduit 54 has a function as a boom-raising proportional solenoid valve. Proportional solenoid valve 75 provided in pump flow path 55 has a function as a boom-raising proportional solenoid valve.

Both second pilot conduit 54 and pump flow path 55 have a function as a boom-raising pilot conduit. More specifically, second pilot conduit 54 functions as a normal boom-raising pilot conduit, and pump flow path 55 functions as a forcible boom-raising pilot conduit. In addition, proportional solenoid valve 74 can be expressed as a normal boom-raising proportional solenoid valve, and proportional solenoid valve 75 can be expressed as a forcible boom-raising proportional solenoid valve.

Hydraulic pressure sensor 63 detects the hydraulic pressure generated in first pilot conduit 53 between first pilot pressure control valve 41A and proportional solenoid valve 73 in accordance with the operation of first control lever 44. Based on the hydraulic pressure detected by hydraulic pressure sensor 63, controller 20 outputs instruction signal G3 to proportional solenoid valve 73 and controls the opening degree of proportional solenoid valve 73. Hydraulic pressure sensor 64 detects the hydraulic pressure generated in second pilot conduit 54 between second pilot pressure control valve 41B and proportional solenoid valve 74 in accordance with the operation of first control lever 44. Based on the hydraulic pressure detected by hydraulic pressure sensor 64, controller 20 outputs instruction signal G4 to proportional solenoid valve 74 and controls the opening degree of proportional solenoid valve 74. Controller 20 outputs instruction signal G5 to proportional solenoid valve 75 and controls the opening degree of proportional solenoid valve 75.

Figure 7:
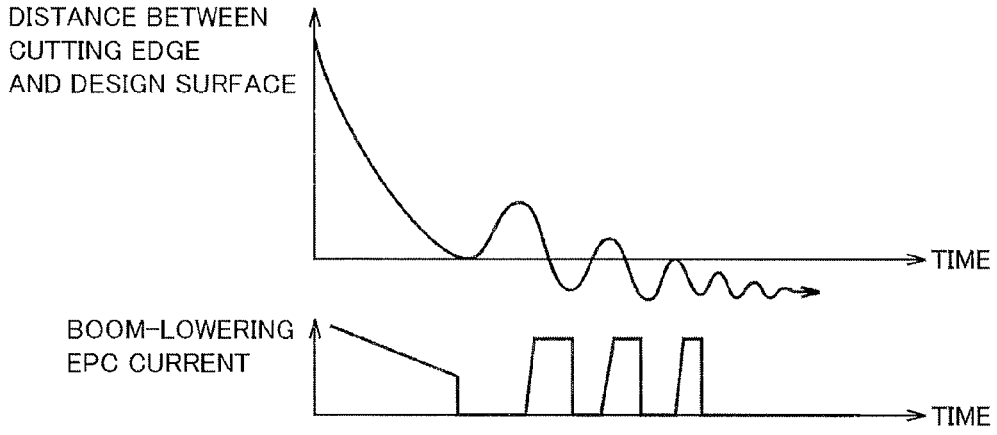
FIG. 7 is a graph showing a change in current when a boom-lowering instruction is provided in the hydraulic excavator before the present invention is applied.

FIG. 7 is a graph showing a change in current when the boom-lowering instruction is provided in hydraulic excavator 1 before the present invention is applied. All of the horizontal axes of the two graphs in FIG. 7 represent the time. The vertical axis of the lower graph in FIG. 7 represents a current outputted to proportional solenoid valve 73 by controller 20 when controller 20 transmits instruction signal G3, and this will be referred to as a boom-lowering EPC current. Proportional solenoid valve 73 is a valve configured such that the opening degree thereof is zero (fully-closed) when the current value is zero, and the opening degree thereof continuously increases with an increase in current value. The vertical axis of the upper graph in FIG. 7 represents a distance between cutting edge 8*a* of bucket 8 and design surface S.

As shown in the upper graph in FIG. 7, due to the boom-lowering operation by the operator, the distance between cutting edge 8*a* of bucket 8 and design surface S decreases with the passage of time from time zero. Controller 20 computes the distance between cutting edge 8*a* of bucket 8 and design surface S. When cutting edge 8*a*, of bucket 8 reaches design surface S and the distance between cutting edge 8*a* and design surface S becomes zero, the value of the boom-lowering EPC current becomes zero and the operation for lowering boom 6 stops automatically as shown in the lower graph in FIG. 7.

At this time, the operator operating hydraulic excavator 1 continues to operate first control lever 44 toward the boom-lowering side until work implement 5 stops automatically. In addition, the operator gradually decreases the inclination angle of first control lever 44 and decreases the boom-lowering EPC current such that the movement speed of work implement 5 becomes lower as cutting edge 8*a* of bucket 8 comes closer to design surface S. As a result, precise alignment of cutting edge 8*a* of bucket 8 with design surface S becomes possible, and shock when boom 6 stops automatically is absorbed.

When control for automatically stopping boom 6 at design surface S is executed, the relative movement speed of work implement 5 with respect to the work vehicle main body of hydraulic excavator 1 changes suddenly, and thus, the work vehicle main body of hydraulic excavator 1 shakes. Due to this shake, the distance between cutting edge 8*a* of bucket 8 and design surface S increases again as shown in the upper graph in FIG. 7. If the operator continues to operate first control lever 44 toward the boom-lowering side after work implement 5 stops by automatic control, boom-lowering is executed at the moment when cutting edge 8*a* temporarily moves upwardly away from design surface S due to the shake of the work vehicle main body. As a result, as shown in the upper graph in FIG. 7, cutting edge 8*a* invades design surface S after the shake of the work vehicle main body stops.

Figure 8:
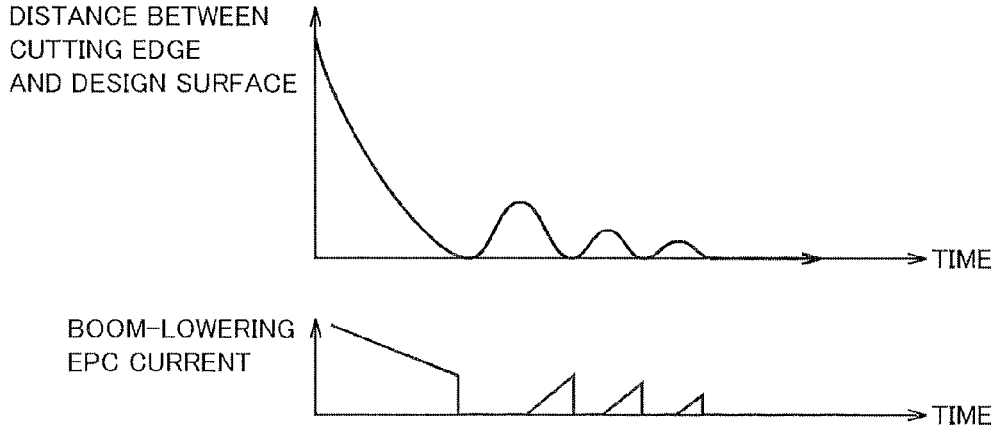
FIG. 8 is a graph showing a change in current when the boom-lowering instruction is provided in the hydraulic excavator according to the embodiment.

Hydraulic excavator 1 according to the present embodiment has been made to solve this phenomenon. FIG. 8 is a graph showing a change in current when the boom-lowering instruction is provided in hydraulic excavator 1 according to the embodiment. All of the horizontal axes of the two graphs in FIG. 8 represent the time. The vertical axis of the lower graph in FIG. 8 represents the boom-lowering EPC current similar to that in FIG. 7. The vertical axis of the upper graph in FIG. 8 represents the distance between cutting edge 8*a* of bucket 8 and design surface S similar to that in FIG. 7.

The lower graph in FIG. 8 and the lower graph in FIG. 7 are compared. Then, in hydraulic excavator 1 according to the present embodiment shown in FIG. 8, the rising of the current value outputted to proportional solenoid valve 73 by controller 20 when boom 6 is lowered is gentle and the current value increases gently from zero. As shown in the lower graph in FIG. 8, in hydraulic excavator 1 according to the present embodiment, an amount of increase in current per unit time when controller 20 outputs, to proportional solenoid valve 73, the instruction signal for instructing an increase in opening degree is smaller than an amount of decrease in current per unit time when controller 20 outputs, to proportional solenoid valve 73, the instruction signal for instructing a decrease in opening degree.

Figure 9:
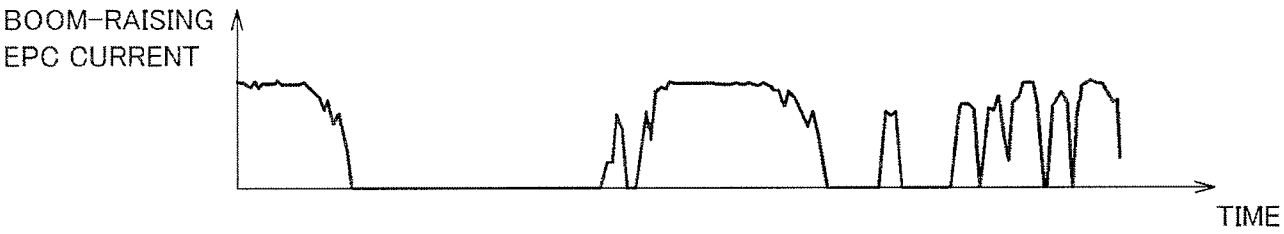
FIG. 9 is a graph showing a change in current when a boom-raising instruction is provided in the hydraulic excavator according to the embodiment.

FIG. 9 is a graph showing a change in current when the boom-raising instruction is provided in hydraulic excavator 1 according to the present embodiment. The horizontal axis of the graph in FIG. 9 represents the time. The vertical axis of the graph in FIG. 9 represents a current outputted to proportional solenoid valve 74 or proportional solenoid valve 75 by controller 20 when controller 20 transmits instruction signal G4 or G5, and this will be referred to as a boom-raising EPC current. The lower graph in FIG. 8 and the graph in FIG. 9 have the same scale in both the vertical axis and the horizontal axis.

The graph in FIG. 9 and the lower graph in FIG. 8 are compared. Then, in hydraulic excavator 1 according to the present embodiment, an amount of increase in current per unit time when controller 20 outputs, to proportional solenoid valve 73, the instruction signal for instructing an increase in opening degree is smaller than an amount of increase in current per unit time when controller 20 outputs, to proportional solenoid valve 74 or 75, the instruction signal for instructing an increase in opening degree.

Figure 10:
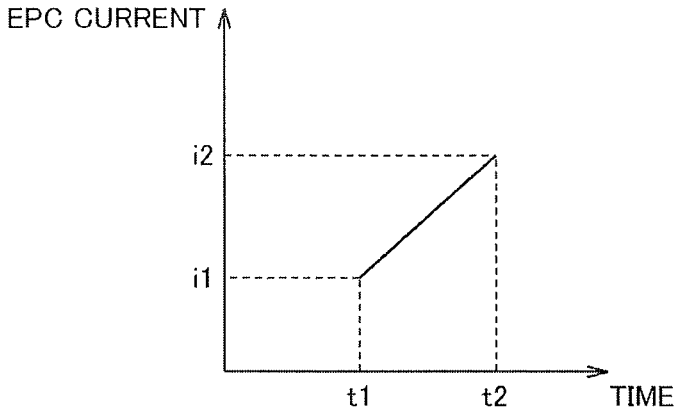
FIG. 10 is a graph showing an increase in current value when an opening degree of a proportional solenoid valve is increased.

The amount of increase in current per unit time will be described. FIG. 10 is a graph showing an increase in current value when the opening degree of the proportional solenoid valve is increased. As shown in FIG. 10, it is assumed that i1 represents a value of the EPC current outputted to the proportional solenoid valve at time t1, and i2 represents a value of the EPC current outputted to the proportional solenoid valve at time t2 later than time t1. When the relationship of i2>i1 is satisfied and the value of the EPC current at time t2 is larger than the value of the EPC current at time t1, the amount of increase in current per unit time has a value obtained by dividing the amount of increase in EPC current by the time from time t1 to time t2.

From the foregoing, the amount of increase in current per unit time is calculated in accordance with the following equation:

$$(\text{amount of increase in current per unit time})=(i2-i1)/(t2-t1).$$

Figure 11:
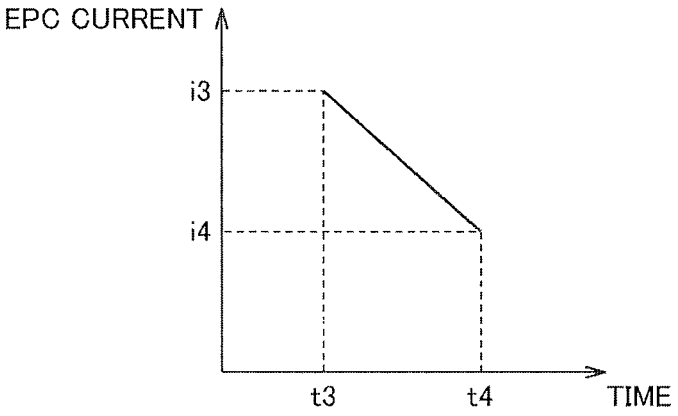
FIG. 11 is a graph showing a decrease in current value when the opening degree of the proportional solenoid valve is decreased.

The amount of decrease in current per unit time will be described. FIG. 11 is a graph showing a decrease in current value when the opening degree of the proportional solenoid valve is decreased. As shown in FIG. 11, it is assumed that i3 represents a value of the EPC current outputted to the proportional solenoid valve at time t3, and i4 represents a value of the EPC current outputted to the proportional solenoid valve at time t4 later than time t3. When the relationship of i3>i4 is satisfied and the value of the EPC current at time t4 is smaller than the value of the EPC current at time t3, the amount of decrease in current per unit time has a value obtained by dividing the amount of decrease in EPC current by the time from time t3 to time t4.

From the foregoing, the amount of decrease in current per unit time is calculated in accordance with the following equation:

$$(\text{amount of decrease in current per unit time})=(i3-i4)/(t4-t3).$$

Next, the function and effect of the present embodiment will be described.

According to the present embodiment, as shown in FIG. 8, the current value outputted to proportional solenoid valve 73 by controller 20 when boom 6 is lowered increases gently from zero. The boom-lowering EPC current shown in FIG. 8 does not increase sharply in the manner of step function, but gradually increases with the passage of time. The boom-lowering EPC current increases to have a gradient with respect to the time. Controller 20 executes control for temporally delaying the increase in boom-lowering EPC current and outputting the boom-lowering EPC current such that the opening degree of proportional solenoid valve 73 increases smoothly with the passage of time when the opening degree of proportional solenoid valve 73 is increased.

The graph before the present invention is applied as shown in FIG. 7 and the graph according to the present embodiment shown in FIG. 8 are compared. Then, the time that elapses before the current value increases from zero and reaches the same value is longer in the present embodiment. By reducing an amplification factor when the boom-lowering EPC current is increased and relatively reducing a rate of increase in current when proportional solenoid valve 73 is opened, the sensitivity of proportional solenoid valve 73 decreases and the valve opening speed of proportional solenoid valve 73 decreases.

Proportional solenoid valve 73 is configured such that the opening operation starts when the current value increases from zero to a prescribed threshold value in the case of increasing the opening degree from the fully-closed state. Proportional solenoid valve 73 may be configured such that the opening operation starts when the boom-lowering EPC current increases to 40% of the rated current. To proportional solenoid valve 73 having such a configuration, controller 20 outputs the gently-increasing current value. As a result, the response speed of the operation for lowering boom 6 with respect to the operator's operation can be decreased.

For example, in the time period during which the boom-lowering EPC current is increasing as shown in FIG. 8, an amount of increase in boom-lowering EPC current per unit time may be set to prevent the current value from increasing to the prescribed threshold value at which boom 6 starts to move. The time period during which the boom-lowering EPC current is increasing can be obtained based on a specified cycle of the shake of the work vehicle.

Therefore, even if cutting edge 8*a* of bucket 8 temporarily moves away from design surface S due to the shake of the work vehicle main body, boom 6 does not move and the relative position of work implement 5 with respect to the work vehicle main body can be maintained. Since it is possible to suppress execution of boom-lowering again when the work vehicle main body shakes, it is possible to prevent cutting edge 8*a* of bucket 8 from being located lower than design surface S and invading design surface S.

In addition, as shown in FIG. 8, the amount of increase in current per unit time when controller 20 outputs, to proportional solenoid valve 73, the instruction signal for instructing an increase in opening degree is smaller than the amount of decrease in current per unit time when controller 20 outputs, to proportional solenoid valve 73, the instruction signal for instructing a decrease in opening degree. Comparing the time when the current value outputted to proportional solenoid valve 73 increases and the time when the current value outputted to proportional solenoid valve 73 decreases, the time required for the current value to change by the same amount is longer when the current value increases. A ratio of increase in opening degree of proportional solenoid valve 73 per unit time is smaller than a ratio of decrease in opening degree of proportional solenoid valve 73 per unit time.

As described above, by reducing the rate of increase in current when proportional solenoid valve 73 is opened, invasion of design surface S by work implement 5 can be prevented. On the other hand, by relatively increasing a rate of decrease in current when proportional solenoid valve 73 is closed as compared with the rate of increase in current when proportional solenoid valve 73 is opened, the valve closing speed of proportional solenoid valve 73 becomes relatively high.

The case of closing proportional solenoid valve 73 during automatic control corresponds to the case in which cutting edge 8*a* of bucket 8 comes sufficiently close to design surface S and the instruction for lowering boom 6 is no longer necessary. In this case, it is desirable to shorten the time to continue the operation for lowering boom 6 and immediately stop the operation for lowering boom 6. By relatively increasing the valve closing speed of proportional solenoid valve 73, the operation for lowering boom 6 can be stopped immediately, and thus, excessive excavation with respect to design surface S can be avoided more reliably. Therefore, the efficiency and quality during the work for leveling the ground with hydraulic excavator 1 can be enhanced.

In addition, as shown in FIGS. 8 and 9, the amount of increase in current per unit time when controller 20 outputs, to proportional solenoid valve 73, the instruction signal for instructing an increase in opening degree is smaller than the amount of increase in current per unit time when controller 20 outputs, to proportional solenoid valve 74 or 75, the instruction signal for instructing an increase in opening degree. Comparing the time that elapses before the current value outputted to each of proportional solenoid valve 73 and proportional solenoid valve 74 or 75 increases from zero and reaches the same value when the current value increases, it takes a longer time in proportional solenoid valve 73. The ratio of increase in opening degree of proportional solenoid valve 73 per unit time is smaller than a ratio of increase in opening degree of proportional solenoid valve 74 or 75 per unit time.

As described above, by reducing the rate of increase in current when proportional solenoid valve 73 is opened, invasion of design surface S by work implement 5 can be prevented. On the other hand, by relatively increasing a rate of increase in current when proportional solenoid valve 74 or 75 is opened as compared with the rate of increase in current when proportional solenoid valve 73 is opened, the valve opening speed of proportional solenoid valve 74 or 75 becomes relatively high. By increasing the sensitivity of proportional solenoid valve 74 or 75, boom 6 can be immediately raised when the operator performs the boom-raising operation.

If the rate of increase in current when the opening degree of proportional solenoid valve 73 is increased is reduced excessively, the responsiveness to the operator's operation decreases. Therefore, it takes time from when the operator operates first control lever 44 to when boom 6 operates, and the operator may feel that the operation of boom 6 is slow and may feel stress. Thus, it is desirable to reduce the rate of increase in current when the opening degree of proportional solenoid valve 73 is increased, so as not to affect the responsiveness of the operation of work implement 5 at the time of manual operation. For example, the rate of increase in current when the opening degree of proportional solenoid valve 73 is increased may be set to fall within 1/100 times or more and ½ times or less of a rate of change in current when the opening degree of proportional solenoid valve 73 is decreased or when the opening degree of proportional solenoid valve 74 or 75 is increased.

It should be understood that the embodiment disclosed herein is illustrative and not limitative in any respect. The scope of the present invention is defined by the terms of the claims, rather than the description above, and is intended to include any modifications within the scope and meaning equivalent to the terms of the claims.

REFERENCE SIGNS LIST

1 hydraulic excavator; 2 undercarriage; 3 upper revolving unit; 4 cab; 5 work implement; 6 boom; 7 arm; 8 bucket; 8*a* cutting edge; 9 boom cylinder; 20 controller; 34 main operation valve; 35 tank; 37 pilot switching valve for the boom; 41 first control lever device; 41A to 41D, 42A to 42D pilot pressure control valve; 42 second control lever device; 44 first control lever; 45 second control lever; 50 third hydraulic pump; 51, 55 pump flow path; 52 tank flow path; 53, 54, 56 to 61 pilot conduit; 63, 64, 66 to 69 hydraulic pressure sensor; 70 relay block; 73 to 79 proportional solenoid valve; 80 shuttle valve; G3 to G9 instruction signal; P3, P4, P6 to P9 pressure signal; S design surface; p1 first pilot port; p2 second pilot port.

The invention claimed is:

1. A hydraulic excavator, comprising:

a boom;

a pilot switching valve for said boom having a boom-lowering pilot port and controlling operation of said boom;

a boom-lowering pilot conduit connected to said boom-lowering pilot port;

a boom-lowering proportional solenoid valve provided in said boom-lowering pilot conduit;

a control lever operated by an operator;

a first pressure sensor detecting a pressure generated in said boom-lowering pilot conduit between said control lever and said boom-lowering proportional solenoid valve; and a controller controlling an opening degree of said boom-lowering proportional solenoid valve based on the pressure detected by said first pressure sensor, wherein said controller gently increases, from zero, a current value outputted to said boom-lowering proportional solenoid valve.

2. The hydraulic excavator according to claim 1, wherein an amount of increase in current per unit time when said controller outputs, to said boom-lowering proportional solenoid valve, an instruction signal for instructing an increase in opening degree is smaller than an amount of decrease in current per unit time when said controller outputs, to said boom-lowering proportional solenoid valve, an instruction signal for instructing a decrease in opening degree.

3. The hydraulic excavator according to claim 1, wherein said pilot switching valve for said boom further has a boom-raising pilot port, said hydraulic excavator further comprising:

a boom-raising pilot conduit connected to said boom-raising pilot port;

a boom-raising proportional solenoid valve provided in said boom-raising pilot conduit; and a second pressure sensor detecting a pressure generated in said boom-raising pilot conduit between said control lever and said boom-raising proportional solenoid valve, wherein said controller controls an opening degree of said boom-raising proportional solenoid valve based on the pressure detected by said second pressure sensor, and the amount of increase in current per unit time when said controller outputs, to said boom-lowering proportional solenoid valve, the instruction signal for instructing an increase in opening degree is smaller than an amount of increase in current per unit time when said controller outputs, to said boom-raising proportional solenoid valve, an instruction signal for instructing an increase in opening degree.

4. The hydraulic excavator according to claim 1, further comprising a bucket having a cutting edge, wherein said controller controls said boom to prevent a position of said cutting edge from becoming lower than construction design data.

5. The hydraulic excavator according to claim 1, wherein said controller transmits and receives information to and from the outside by satellite communication.

6. The hydraulic excavator according to claim 2, wherein said pilot switching valve for said boom further has a boom-raising pilot port, said hydraulic excavator further comprising:

a boom-raising pilot conduit connected to said boom-raising pilot port;

a boom-raising proportional solenoid valve provided in said boom-raising pilot conduit; and a second pressure sensor detecting a pressure generated in said boom-raising pilot conduit between said control lever and said boom-raising proportional solenoid valve, wherein said controller controls an opening degree of said boom-raising proportional solenoid valve based on the pressure detected by said second pressure sensor, and the amount of increase in current per unit time when said controller outputs, to said boom-lowering proportional solenoid valve, the instruction signal for instructing an increase in opening degree is smaller than an amount of increase in current per unit time when said controller outputs, to said boom-raising proportional solenoid valve, an instruction signal for instructing an increase in opening degree.

7. The hydraulic excavator according to claim 2, further comprising a bucket having a cutting edge, wherein said controller controls said boom to prevent a position of said cutting edge from becoming lower than construction design data.

8. The hydraulic excavator according to claim 2, wherein said controller transmits and receives information to and from the outside by satellite communication.

* * * * *